US012312200B2

(12) United States Patent
Cenni

(10) Patent No.: US 12,312,200 B2
(45) Date of Patent: May 27, 2025

(54) METHOD AND SYSTEM FOR DETECTING A TRAVERSE WINDING DEFECT

(71) Applicant: Conductix Wampfler France, Belley (FR)

(72) Inventor: Hugues Cenni, Lapanouse de Cernon (FR)

(73) Assignee: CONDUCTIX WAMPFLER FRANCE, Belley (FR)

( * ) Notice: Subject to any disclaimer, the term of this patent is extended or adjusted under 35 U.S.C. 154(b) by 243 days.

(21) Appl. No.: 17/925,853

(22) PCT Filed: May 17, 2021

(86) PCT No.: PCT/FR2021/050848
§ 371 (c)(1),
(2) Date: Nov. 17, 2022

(87) PCT Pub. No.: WO2021/234256
PCT Pub. Date: Nov. 25, 2021

(65) Prior Publication Data

US 2023/0192438 A1 Jun. 22, 2023

(30) Foreign Application Priority Data

May 19, 2020 (FR) ..... 2005125

(51) Int. Cl.
*B65H 54/28* (2006.01)

(52) U.S. Cl.
CPC ..... *B65H 54/2866* (2013.01); *B65H 54/2878* (2013.01); *B65H 2553/81* (2013.01)

(58) Field of Classification Search
CPC ..... B65H 54/2866; B65H 54/2878; B65H 54/2854
See application file for complete search history.

(56) References Cited

U.S. PATENT DOCUMENTS 3,967,787 A * 7/1976 Mulleman ..... B65H 54/385 242/478.2
4,004,744 A * 1/1977 Hoorelbeke ..... B65H 54/2866 242/478.2

(Continued)

FOREIGN PATENT DOCUMENTS

JP H08217330 A 8/1996
JP H08217333 A 8/1996

(Continued)

OTHER PUBLICATIONS

International Search Report for Application No. PCT/FR2021/050848, dated Sep. 1, 2021.

(Continued)

*Primary Examiner* — Sang K Kim
(74) *Attorney, Agent, or Firm* — Ryan T. Grace; Advent, LLP

(57) ABSTRACT

The invention relates to a method for detecting a traverse winding defect when winding a link (L) on a spool (1) rotatably driven about a longitudinal axis (X), the link (L) being alternately translationally guided relative to the spool (1) by a guide pulley (2) along said longitudinal axis (X) between two reversal positions, comprising:

measuring the position of the guide pulley (2) relative to the spool (1) along the longitudinal axis (X) over time, measuring the position (P2) of a regulation device for regulating the advance speed of the link on the guide pulley over time, from said measurements, determining a deviation between the position (P3) of the regulation device and a reference position (P3*r*) at each reversal position (Pi1, Pi2), and from said deviation, detecting the formation of a hollow or bump in the winding.

10 Claims, 1 Drawing Sheet

(56) References Cited

U.S. PATENT DOCUMENTS

| | | | | | |
|---|---|---|---|---|---|
| 4,527,749 | A * | 7/1985 | Matthews | B65H 59/38 | 242/912 |
| 5,082,193 | A * | 1/1992 | Boni | B65H 54/2866 | 242/476.7 |
| 5,297,748 | A * | 3/1994 | LeCompte | B65H 63/00 | 242/413.5 |

FOREIGN PATENT DOCUMENTS

| | | | |
|---|---|---|---|
| JP | H09276932 | A | 10/1997 |
| JP | 2003341932 | A | 12/2003 |
| JP | 2006008310 | A | 1/2006 |
| JP | 2008001451 | A | 1/2008 |
| JP | 2010001115 | A | 1/2010 |
| WO | 0039013 | A1 | 7/2000 |
| WO | 2012130647 | A1 | 10/2012 |
| WO | 2015151073 | A1 | 10/2015 |

OTHER PUBLICATIONS

Preliminary Search Report for Application No. FR2005125, dated Jan. 22, 2021.

* cited by examiner

METHOD AND SYSTEM FOR DETECTING A TRAVERSE WINDING DEFECT

FIELD OF THE INVENTION

The invention relates to a method and a system for detecting a traverse winding defect.

STATE OF THE ART

There are a number of applications where a link intended to carry fluid or transmit energy and/or signals (for example, electrical current, optical signals, mechanical tension, fluid, etc.) has to be wound on a spool, in order to be transported, stored and/or used.

In general, it is necessary that the winding of the link on the spool is even, that is, that the link is wound on the spool in the form of one or more successive layers of joining coils or having a minimum of clearance between them. Such even winding ensures the mechanical integrity of the link and also allows the link to be unwound with a substantially constant tension of the link.

To this end, the winding system for winding the link is fitted with a traverse winding system, which comprises a guide pulley arranged facing the spool, adapted to control the location of each new coil relative to the coils already deposited on the core of the spool. When the link is wound, the spool is rotatably driven about the revolution axis of the core, and the guide pulley is alternately translationally driven relative to the spool (or vice versa) in a direction parallel to said axis, between two reversal positions which are located near each of the two flanges of the spool.

However, it may be the case that, due to a faulty adjustment of the reversal positions of the guide pulley, too much length of the link accumulates near a flange of the spool, resulting in a bump on the external surface of all the turns, or, on the contrary, the link is not wound up to the flange, resulting in a hollow on the external surface of all the coils.

Indeed, the width of the spool, which corresponds to the distance between the two flanges, is not always known accurately. For example, if the spool is made of moulded plastic, there may be significant dimensional variations between two similar spools.

Moreover, as the link is wound on the spool, the flanks may move apart due to the pressure of the link, which affects the filling of the spool.

Such a defect can be visually observed by an operator and corrected by changing the dimension of the reversal positions.

However, this detection is not accurate and can only be performed when a significant winding defect has been observed, which is not satisfactory.

Document JPH09276932 describes a traverse winding system for winding an optical fibre onto a spool, comprising a motor with a rotary encoder, a ball screw coupled to the motor and the spool to alternately translationally drive the spool in two traverse winding directions facing a fixed pulley. The motor changes direction of rotation based on data from proximity sensors arranged on a support, which detect the position of the flanges of the spool. The device further comprises a sensor for detecting the position of the optical fibre, and a control device that controls the direction of rotation of the motor based on a speed signal of the fibre at the pulley and a traverse winding position signal provided by the encoder. A curve is drawn representing the position of the wire at the time of a traverse winding direction change, detected by the detector. The presence of a bump indicates an extra thickness of spooling at a flange of the spool. In response to the detection of such an extra thickness, the control device adjusts the reversal position of the traverse winding direction. The result is a reduction of the bump at the next reversal position.

Document JPH08217333 describes a traverse winding system comprising a sensor for measuring the distance of the axis of the guide pulley relative to one of the flanges of the spool. The moment of change of the traverse winding direction is determined on the basis of geometrical considerations. The traverse winding direction is reversed when the distance between the wire and the flange is less than half the diameter of the wire.

Document JPH08217330 describes a traverse winding system in which the speeds of wire advance and winding on the spool are controlled by means of respective encoders, so that these two speeds are made equal.

DISCLOSURE OF THE INVENTION

One purpose of the invention is to design a method for detecting a traverse winding defect that can be implemented automatically.

Advantageously, this detection method should also be compatible with a method for automatically correcting the traverse winding defect.

To this end, the invention provides a method for detecting a traverse winding defect when winding a link on a spool rotatably driven about a longitudinal axis, the link being alternately translationally guided by an guide pulley relative to the spool along said longitudinal axis between two reversal positions, comprising:

- measuring the position of the guide pulley relative to the spool along the longitudinal axis over time, —measuring the position of a regulation device for regulating the advance speed of the link on the guide pulley over time,
- from said measurements, determining a deviation between the position of the regulation device and a reference position at each reversal position, and
- from said deviation, detecting the formation of a hollow or bump in the winding.

According to one embodiment, the regulation device for regulating the advance speed of the link is a replica comprising a pulley arranged at the end of an arm capable of pivoting about a horizontal axis against the return load of a spring, and wherein the measured position is the angular position of the replica arm relative to a vertical axis.

In this text, by "horizontal", it is meant a direction perpendicular to the direction of gravity, and by "vertical", the direction of gravity.

Particularly advantageously, measuring the position of the control device is carried out in a measurement window encompassing each reversal position.

Preferably, the minimum and maximum positions of the regulation device are determined in each measurement window and deviations between each respective minimum or maximum position and the reference position of the regulation device are calculated.

Particularly advantageously, the method comprises comparing the absolute values of said deviations and determining:

- the formation of a hollow in the winding if the absolute value of the deviation between the maximum position and the reference position is greater than the absolute value of the deviation between the minimum position and the reference position, the formation of a bump in the winding if the absolute value of the deviation between the maximum position and the reference position is less than the absolute value of the deviation between the minimum position and the reference position.

From the deviations thus calculated, a traverse winding error can be determined as being equal to:

the deviation between the maximum position and the reference position if said deviation is greater in absolute value than the deviation between the minimum position and the reference position, and the deviation between the minimum position and the reference position if said deviation is greater in absolute value than the deviation between the minimum position and the reference position to which an offset is added which is a function of the rotation speed of spool, the deviation between the maximum position and the reference position in other cases.

Another object of the invention relates to a system for detecting a traverse winding defect when winding a link on a spool rotatably driven about a longitudinal axis, the link being alternately translationally guided by a guide pulley relative to the spool along said longitudinal axis between two reversal positions. Said system comprises:

a first sensor adapted to measure the position of the guide pulley relative to the spool along the longitudinal axis over time, a second sensor adapted to measure the position of a regulation device for regulating the advance speed of the link on the guide pulley over time, a control unit configured to:

(a) from the measurement data of the first and second sensors, determine a deviation between the position of the regulation device and a reference position at each reversal position, and (b) from said deviation, detect the formation of a hollow or bump in the winding.

In some embodiments, the regulation device for regulating the advance speed of the link is a replica comprising a pulley arranged at the end of an arm capable of pivoting about a horizontal axis against the return load of the spring, and wherein the measured position is the angular position of the replica arm relative to a vertical axis.

Another object of the invention relates to a winding system for winding a link on a spool rotatably driven about a longitudinal axis, comprising:

a spooler configured to rotatably drive the spool about the longitudinal axis, a guide pulley for alternately translationally guiding the link relative to the spool along the longitudinal axis between two reversal positions, so as to perform an even helical winding of the link guided by the pulley on the spool, a regulation device arranged upstream of the guide pulley on the path of the link to regulate the advance speed of the link, a detection system for detecting a traverse winding defect as described above.

In some embodiments, the spooler is configured to only rotatably drive the spool, with the system comprising an actuator 8A configured to translationally drive the guide pulley along the longitudinal axis.

In other embodiments, the guide pulley is fixed and the spooler comprises an actuator 8B configured to rotatably and translationally drive the spool relative to the guide pulley.

Finally, the invention relates to a link winder comprising a winding system as described above.

BRIEF DESCRIPTION OF FIGURES

Further characteristics and advantages of the invention will appear from the following detailed description, with reference to the attached drawings, in which.

DETAILED DESCRIPTION OF EMBODIMENTS

Figure 1:
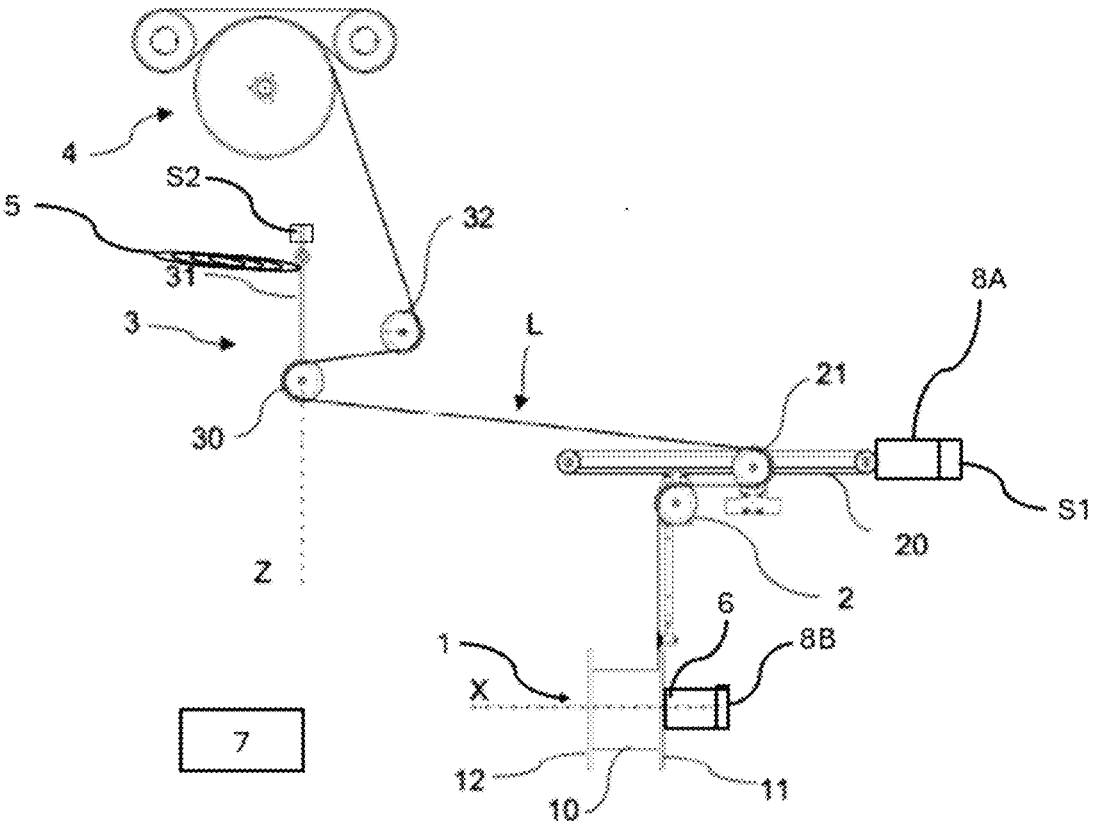
FIG. 1 is an overview of a winding system for winding a link on a spool in which the method for detecting a traverse winding defect is implemented according to the invention.

FIG. 1 is an overview of a winding system for winding a link L on a spool. Such a system is usually part of a winder, which is a machine the function of which is to store said link on a spool, for example after its manufacture or after a link test.

The link may be an electrical cable, an optical fibre or optical fibre bundle, a mechanical cable, a hydraulic or pneumatic conduit, or any other appropriate means for transporting fluid or transmitting energy and/or signals.

The spool 1 comprises a cylindrical core 10 to receive the link in the form of evenly wound coils, and two flanges 11, 12 to retain the link on the core.

The spool is integral with a spooler 6 comprising a motor adapted to rotatably drive the spool along a longitudinal axis X, which is the revolution axis of the cylindrical core 10.

The spool may be at the outlet of a link production machine, including an extrusion line, a link testing machine, or any other machine in which the link is advanced before it is wound onto the spool. The winder can be an integral part of or juxtaposed to the machine.

The machine has not been represented in FIG. 1, apart from an outlet capstan 4, the function of which is to apply mechanical tension in the link.

Between the capstan 4 and the spool, a number of pulleys are arranged, one of which is referred to by item 32 and the other by item 21, but not all of which have necessarily been represented in FIG. 1.

The winding of the link on the spool is carried out in the form of helical laps with joining coils, obtained by combining two motions:

the rotation of the spool about the axis X, the axial movement (that is, along the axis X) of the link, carried out by means of a traverse winding system, the function of which is to perform an even helical winding of the link on the spool by axially moving the inlet point of the wire proportionately to the rotation of the spool.

In general, the axis X is located in a horizontal plane, which is generally parallel to the floor plane of the installation in which the link winding is implemented.

The traverse winding system comprises a regulation device for regulating the advance speed of the link and a guide pulley for guiding the link.

The regulation device for regulating the speed of the link is represented in the form of a replica 3 which comprises an arm 31 pivotably movable about an axis perpendicular to the axis X against the return load of a spring 5, and a pulley 30 arranged at the end of the arm opposite to the pivot axis. In FIG. 1, the axis 31 is colinear with a vertical axis Z, but it can be tilted to either side relative to this axis.

The angular position of the arm 31 is adjusted to regulate differences in the advance speed of the link.

The guide pulley 2 is located between the replica 3 and the spool 1 on the path of the link.

The function of pulley 2 is to bring the link facing the core of the spool to guide its winding.

The pulley 32, which is arranged upstream of the replica in the path of the link, increases the bar feed on the replica 30 and keeps the inlet angle on the replica constant.

The pullet 21 performs the compensator function configured so that the length between the replica and the traverse winding system is the same regardless of the position of the guide sheave. The pulley 21 moves along the axis X by half the traverse winding pitch at each traverse winding pitch.

In the illustrated embodiment, the spool is translationally fixed and the guide pulley is alternately translationally movable along the axis X of the spool. The guide pulley 2 is thus integral with a belt 20. A motor (not represented) alternately translationally moves the belt along the axis X.

In an alternative embodiment (not represented), the guide pulley may be translationally fixed and the spool could be translationally movable (in addition to its rotational motion) along the axis X.

The movement of the guide pulley 2 relative to the spool is carried out alternately in both directions, between two reversal positions, which are the extreme positions of movement of the guide pulley relative to the spool.

Said reversal positions are determined as a function of the position of the flanges, in order to ensure that the first and last coils of each helical lap are positioned as close as possible to each flange, so as not to generate hollows in the external surface of the laps.

In practice, the reversal positions can be determined when loading a new spool, by measuring the positions of one of the flanges relative to the other that is considered to be the origin of the measurement.

The traverse winding system comprises several sensors, which are usually present in the traverse winding systems on the market and therefore do not need to be specifically added for the implementation of the invention.

A first sensor S1 measures the position of the guide pulley 2 relative to the spool 1 along the axis X over time. For example, this sensor can be an encoder of the motor that actuates the belt integral with the guide pulley.

A second sensor S2 is used to measure the angular position of the replica 3 relative to the axis Z over time.

The system further comprises a control unit 7 comprising at least one processor adapted to implement algorithms for calculating a traverse winding defect.

The control unit receives the measurement data from the different sensors.

From this data, the processor determines a deviation between the angular position of the replica and a reference angular position at each reversal position.

From the deviation thus determined, the processor detects the formation of a hollow or bump in the winding.

Figure 2:
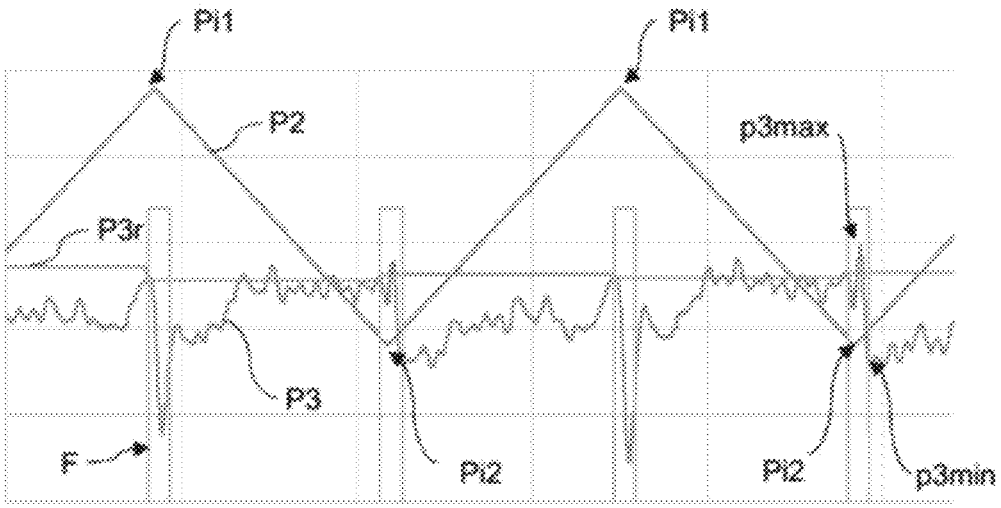
FIG. 2 is a schematic diagram of the position measurement of the regulation device for regulating the speed of the link.

FIG. 2 illustrates the principle of measuring the angular position of the replica.

The abscissa axis is a time axis.

The ordinate axis represents the position of the guide pulley and the angular position of the replica (arbitrary units).

The triangular graph P2 represents the change of the position of the guide pulley as a function of time. This position changes periodically between two successive reversal positions Pi1 and Pi2, which correspond to the tips of the triangles.

Curve P3 represents the change of the angular position of the replica relative to the axis Z over time.

Curve P3*r* represents the change of a reference angular position of the replica relative to the axis Z over time. In FIG. 2, it is observed that this reference angular position takes two different constant values during a forward and backward movement of the guide pulley between the two reversal positions Pi1, Pi2.

Particularly advantageously, the angular position of the replica is not measured occasionally at each reversal position, but in a measurement time window F encompassing each reversal.

The reference angular position P3*r* can be determined as the arithmetic mean of the instantaneous angular positions of the replica measured when opening the window during a number of measurements (for example, 50 measurements) preceding the current measurement, for the same reversal position Pi1 or Pi2. This smooths the measurement and avoids the consideration of small disturbances without altering the useful signal related to the actual replica movement.

Between the opening and closing of said measurement window, the instantaneous angular position of the replica is recorded. The minimum p3min and maximum p3max positions in the window F are determined and saved.

From these measurements, a deviation Δmin equal to the deviation between the reference position P3*r* and the minimum angular position p3min of the replica in the corresponding window is determined for each reversal position, and a deviation Δmax equal to the deviation between the reference position P3*r* and the maximum angular position p3max of the replica in that window is determined.

Particularly advantageously, the deviation Δmin integrates an offset applied to the minimum position p3min to take into account the fact that the replica has a natural (decreasing) motion at reversal. This offset is a function of the winding speed of the link. The control unit may comprise a memory in which different predetermined values of the offset to be applied as a function of the winding speed are stored.

By comparing the absolute values of the two deviations Δmin and Amax in the same window, a tendency to form a hollow or bump in the winding can be detected.

Indeed, a hollow is characterised by a smaller link winding radius; therefore, for a given rotation speed of the spool, the wound link length is smaller, which results in a movement of the shoe in the direction of an increase in the deviation Δmax. An absolute value of Amax greater than the absolute value of Δmin is therefore representative of the formation of a hollow in the winding.

On the contrary, a bump is characterised by a larger link winding radius; therefore, for a given rotation speed of the spool, the wound link length is greater, which results in a movement of the shoe in the direction of an increase in the deviation min A. An absolute value of Amax less than the absolute value of Δmin is therefore representative of the formation of a bump in the winding.

A traverse winding error can then be defined as the highest absolute value of the deviations Δ max and Δmin. In the case where these two deviations have close values, it is preferable to detect a hollow because the detection of a hollow is more significant than that of a bump, which is biased by the offset which is not accurately determined. Thus, in practice, if the absolute value of Amax is greater than that of Δmin, the value Δmax will be assigned to the traverse winding error. If the absolute value of Δmin is greater than the absolute value of Amax to which an offset which is a function of the winding speed is added, the value Δmin is assigned to the traverse winding error. If the absolute values of Amax and Δmin are close, the value Δmax will be assigned to the traverse winding error.

Since the amplitude of the oscillations of the replica increases with the rotation speed of the spool, it is possible to apply an error harmonisation term, proportional to the speed of the spool, to have the same order of magnitude of the error for a same deviation, regardless of the speed of the spool.

Although the description of the method for detecting the traverse winding defect has been made for a regulation replica, frequently used in particular for winding fine and/or fragile links, the angular position of which is measured relative to the vertical, the person skilled in the art employs any other regulation device fitted with a position sensor, and uses the measurements of this position in a measurement window encompassing each reversal position, according to the same principle as that set out above.

Regardless of the regulation device used, the invention has the advantage of using a sensor integrated in this regulation device to detect a traverse winding defect, without requiring any additional means of measurement. Implementation of the traverse winding defect detection therefore does not require any structural modification of the traverse winding system and can therefore be carried out at a lower cost.

The invention claimed is:

1. A method for detecting a traverse winding defect when winding a link on a spool rotatably driven about a longitudinal axis, the link being alternately translationally guided relative to the spool by a guide pulley along said longitudinal axis between two reversal positions, comprising:

measuring the position of the guide pulley relative to the spool along the longitudinal axis over time;

measuring the position of a regulation device for regulating an advance speed of the link on the guide pulley over time, the measuring being carried out in a measurement window encompassing each reversal position;

from said measurements, determining a deviation between a position of the regulation device and a reference position at each reversal position; and from said deviation, detecting the formation of a hollow or bump in the winding, wherein minimum and maximum positions of the regulation device are determined in each measurement window and deviations between each respective minimum or maximum position and the reference position of the regulation device are calculated.

2. The method according to claim 1, wherein the regulation device for regulating the advance speed of the link is a replica comprising a pulley arranged at an end of an arm capable of pivoting about a horizontal axis against the return load of a spring, and wherein the measured position is an angular position of the arm of the replica relative to a vertical axis.

3. The method according to one of claim 1, comprising comparing absolute values of the deviations and determining:

the formation of a hollow in the winding if an absolute value of the deviation between the maximum position and the reference position is greater than an absolute value of the deviation between the minimum position and the reference position, the formation of a bump in the winding if an absolute value of the deviation between the maximum position and the reference position is less than an absolute value of the deviation between the minimum position and the reference position.

4. The method according to claim 1, wherein a traverse winding error is determined to be equal to:

the deviation between the maximum position and the reference position if the deviation is greater in absolute value than the deviation between the minimum position and the reference position, and the deviation between the minimum position and the reference position if said deviation is greater in absolute value than the deviation between the minimum position and the reference position to which an offset which a function of the rotation speed of the spool is added, the deviation between the maximum position and the reference position in other cases.

5. A system for detecting a traverse winding defect when winding a link on a spool rotatably driven about a longitudinal axis, the link being alternately translationally guided by a guide pulley relative to the spool along said longitudinal axis between two reversal positions, comprising:

a first sensor arranged to measure the position of the guide pulley relative to the spool along the longitudinal axis over time;

a second sensor adapted to measure the position of a regulation device for regulating the advance speed of the link on the guide pulley over time in a measurement window encompassing each reversal position; and a control unit receiving the measurement data from the first sensor and the second sensor, the control unit being configured to:

from the measurement data of the second sensor, determine the minimum and maximum positions of the regulation device in each measurement window, from the measurement data of the first and second sensors, determine a deviation between the position of the regulation device and a reference position at each reversal position, and from said deviation, detect the formation of a hollow or bump in the winding.

6. The system according to claim 5, wherein the regulation device for regulating the advance speed of the link is a replica comprising a pulley arranged at an end of an arm capable of pivoting about a horizontal axis against the return load of a spring, and wherein the measured position is an angular position of the replica arm relative to a vertical axis.

7. A winding system for winding a link on a spool rotatably driven about a longitudinal axis, comprising:

a spooler comprising a motor adapted to rotatably drive the spool about the longitudinal axis;

a guide pulley for alternately translationally guiding the link relative to the spool along the longitudinal axis between two reversal positions, so as to perform an even helical winding of the link guided by the pulley on the spool;

a regulation device arranged upstream of the guide pulley on the path of the link to regulate the advance speed of the link; and a system for detecting a traverse winding defect according to claim 5.

8. The system according to claim 7, wherein the spooler is configured to only rotatably drive the spool, the system comprising an actuator configured to translationally drive the guide pulley along the longitudinal axis.

9. The system according to claim 8, wherein the guide pulley is fixed and the spooler comprises an actuator configured to rotatably and translationally drive the spool relative to the guide pulley.

10. A link winder comprising a winding system according to claim 7.

* * * * *